United States Patent [19]

Brownstein

[11] Patent Number: 4,703,790

[45] Date of Patent: Nov. 3, 1987

[54] SOLIDIFIED SURFACE MONITORED CONTINUOUS METAL CASTING SYSTEM

[76] Inventor: Raymond G. Brownstein, 1001 N. Davis St., Albany, Ga. 31701

[21] Appl. No.: 778,200

[22] Filed: Sep. 20, 1985

[51] Int. Cl.[4] ..... B22D 11/06; B22D 11/10; B22D 11/18

[52] U.S. Cl. ..... 164/155; 164/415; 164/429; 164/438

[58] Field of Search ..... 164/155, 429, 415, 475, 164/479, 453, 72, 74, 438

[56] References Cited

U.S. PATENT DOCUMENTS

| | | | |
|---|---|---|---|
| 2,544,837 | 3/1951 | Jordan | 164/429 |
| 3,343,590 | 9/1967 | Radd | 164/479 |
| 3,603,378 | 9/1971 | Yearley | 164/429 X |
| 3,703,204 | 11/1972 | Brownstein | 164/429 X |
| 3,730,254 | 5/1973 | Namy | 164/155 X |
| 3,818,971 | 6/1974 | Schutz | 164/155 X |

*Primary Examiner*—Nicholas P. Godici
*Assistant Examiner*—J. Reed Batten, Jr.
*Attorney, Agent, or Firm*—Parmelee, Miller, Welsh & Kratz

[57] ABSTRACT

An improved integrated system is provided for horizontally-longitudinally cast-forming a continuous length of metal ingot. An ablative material is fed lengthwise and introduced as a lining on a continuous, forwardly moving, heat-resistant flexible belt. The ablative material and the belt are shaped into a composite, forwardly moving, open top, trough-like shape into which molten metal is introduced by a ladle that is rotated at a desired supplying rate. The ablative is charred by the molten metal to provide an initial cooling action on the metal as received and to thereafter protect it and the belt while the composite and the metal are forwardly advanced along a channel-shaped, longitudinally extending, metal ingot-forming, casting station. Molten metal is introduced through a refractory nozzle that is positioned in a spaced relation with respect to the ablative lining of the composite, and back flow of the metal is prevented by a second, backwardly spaced nozzle that is also carried in a spaced relation with respect to the ablative and through which air or a suitable inert gas is supplied under pressure behind the molten metal supply nozzle. Metal is introduced into the nozzle from a pouring ladle which is carried on a turntable-like cradle in such a manner that the rate of pouring can be controlled by turning movement of the ladle. A monitor unit having a roller adapted to engage an upper surface of the metal, as at least partially solidified, has an electrical control for the cradle to select and maintain the feed of the molten metal to provide a desired thickness of the ingot being formed.

13 Claims, 13 Drawing Figures

SOLIDIFIED SURFACE MONITORED CONTINUOUS METAL CASTING SYSTEM

BACKGROUND OF THE INVENTION

This invention has been devised to meet the need for an improved type of direct, continuous, in-line metal casting system and to incorporate features in such a system that eliminate limitations and disadvantageous features that have heretofore occurred. The purpose is to increase the efficiency of operation and enable the production of a better continuous casting from the standpoint of its quality and control of its size or shape.

My U.S. Pat. No. 3,703,204, shows an early development of a continuous horizontal casting process or method of which the present invention is an improvement. Also, the Ross Pat. No. 3,281,903, is of interest in this particular connection, however, it presents a problem from the standpoint of its use of a plurality of metal molds, the quality of the ingot obtained, and a tendency for the molten metal to stick to the casting molds.

SUMMARY OF THE INVENTION

It has been an object of the present invention to incorporate features of improvement over the prior art that will facilitate the production of and provide controls for obtaining a better cast metal product.

Another object has been to devise a system in which feed of the molten metal may be selected and meticulously and accurately controlled during the operation and in such a manner as to assure a desired cross dimension of the casting.

A further object has been to improve the approach to the supplying of molten metal to a continuous, ablative-lined, forwardly advancing composite mold, and in such a manner as to better control the quality as well as the rate of feed of the metal, all without any danger of stripping the ablative from its supporting belt.

A still further object of the invention has been to generally improve the continuous horizontal casting of a metal such as steel and to enable the provision of a better quality product.

DETAILED DESCRIPTION OF PREFERRED EMBODIMENTS

Figures 1, 10, 11, 12:
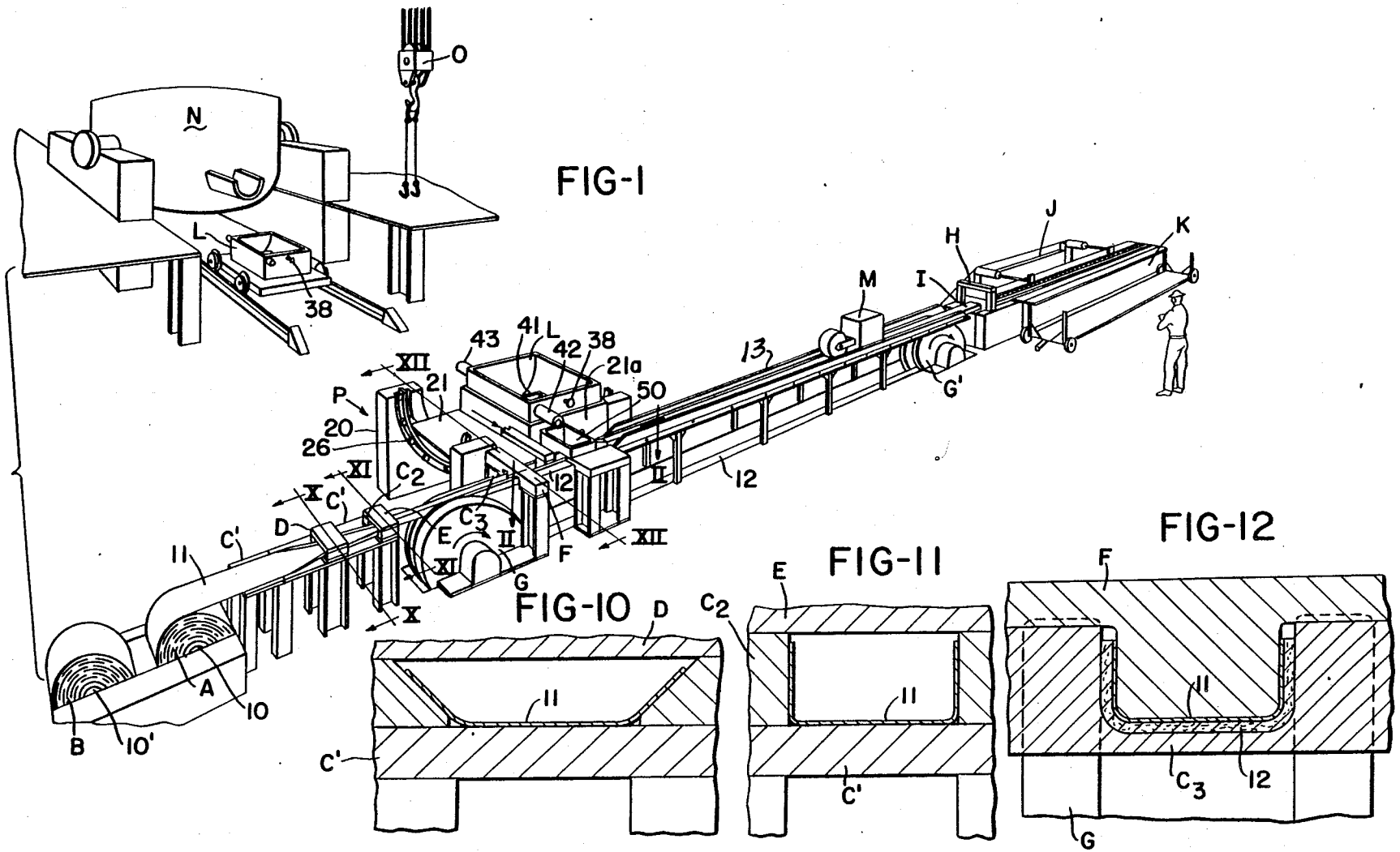
FIG. 1 is a perspective view in elevation of a layout of an improved system of the invention showing a horizontal, longitudinally extending metal casting line.
FIG. 10 is a fragmental sectional end view in elevation on the same scale as FIG. 2 and taken along the line X—X of FIG. 1.
FIG. 11 is a vertical end section in elevation on the same scale as FIG. 10 and taken along the line XI—XI of FIG. 1.
FIG. 12 is a vertical end section on the same scale as FIGS. 10 and 11 and taken along the line XII—XII of FIG. 1.

Referring to FIG. 1 of the drawings, I have shown a typical layout involving the precepts of my invention. As indicated, molten metal to be cast into a slab or ingot length is provided by a furnace N which is positioned to deliver a charge from its spout into a ladle L which is shown mounted on a track for aligning movement with respect to the furnace. An overhead crane O with suitable ladle hooks, as indicated in the drawings, may be utilized to hook-over a pair of lift lugs or trunnions 38 extending from the ladle L to move it and its molten metal content to a pouring position on a cradle 21 within a cradle frame or stand 20 at station P. Initially, the ladle L, as shown in FIG. 1, may be received in a fully horizontal position on rotatable, roller-mounted cradle 21 for tilting-pouring its metal charge. Metal may then be progressively poured into a refractory receptacle furnace spout or nozzle, such as 50 at pouring or supplying station P, either into a refractory tray portion 55 of a refractory spout or nozzle 53 (see FIG. 5) or into receptacle or tundish 50 (see FIG. 3) that may have a stopper 51 for cooperating with shaped feed opening 52 to limit a maximum rate of out-flow of molten metal into the refractory feed spout 53. Actual control of the rate of supply of molten metal from a forwardly sloped delivery end portion 54 of the spout 53 is accomplished by a sensor unit M (see FIGS. 1 and 6).

The unit M works differently from an ordinary sensor in that once the tension of its spring 31 is set by adjustment screw 30, it enables a constant, non-varied feed of molten metal that accurately assures a selected thickness of the cast metal or ingot I. That is, it serves as a monitor for a particular selected thickness of the metal casting being produced, such that the rate of feed of molten metal is maintained constant at such a setting and, as involved by a constant appropriate rate of rotative tilting of the ladle L, as effected by the cradle 21. The engagement of the roller 37 with the upper surface of the forwardly advancing solidified cast workpiece I thus assures a constant rate of molten metal feed. It also makes possible the elimination of a conventional feed means, such as represented by the tundish 50 and stopper 51 shown in FIG. 3.

Again referring particularly to FIG. 1 of the drawings, the aft or rear portion of production line shown is provided with an ablative roll A that is removably mounted on an axle shaft 10 for direct feed forwardly as a continuous planar strip 11. An auxiliary or supplemental roll B is shown removably mounted on shaft 10' for alternate use when the roll A has been exhausted. At this time, a new roll A may be inserted on the shaft 10 ready for use after the roll B has, in turn, become exhausted.

The ablative strip 11 which may be of a heavy paper or somewhat flexible cardboard material (see U.S. Pat. No. 3,703,204) is shown as advanced forwardly over a flat entry guide rail C' into and through an overhead, cross-extending, preliminary, enclosed, trough-shaped entry guide D that is positioned on to extend across the guide rail C'. It initiates, as shown in FIG. 10, the shaping of the ablative material 11 as it is advanced forwardly by a motor-driven, belt-carrying, rear pulley or roll G. From the entry guide unit D, the ablative material 11 then enters a forwardly advanced, overhead, rectangular-shaped guide unit $C_2$, E (see FIGS. 1 and 11) from which it is then introduced into position as a liner within a continuous, heat-resistant, flexible belt 12 which is being moved forwardly by the pulley G (see FIG. 12). As shown in FIG. 12, a guide head of T-shape F cooperates with a longitudinally extending, trough-shaped bottom guide portion $C_3$ in finally shaping the belt 12 and the ablative 11 as a composite; this is effected while the belt and the ablative are being continuously advanced as a composite from rear pulley G towards a head pulley G' of a belt conveying system. After the forming of an open-top composite by the unit $C_3F$ of FIGS. 1 and 12, the refractory feed spout 53 at a molten metal supplying position (see FIGS. 2 and 3) may be employed to introduce molten metal thereto. Thereafter, the composite with molten metal received in its trough, is advanced along a casting line defined by a longitudinally, horizontally extending molding channel assembly 13 having an open-top, rectangular cross-section (see FIGS. 1, 3 and 4).

Figures 2, 3, 4, 5, 6, 6A, 7, 8, 9:
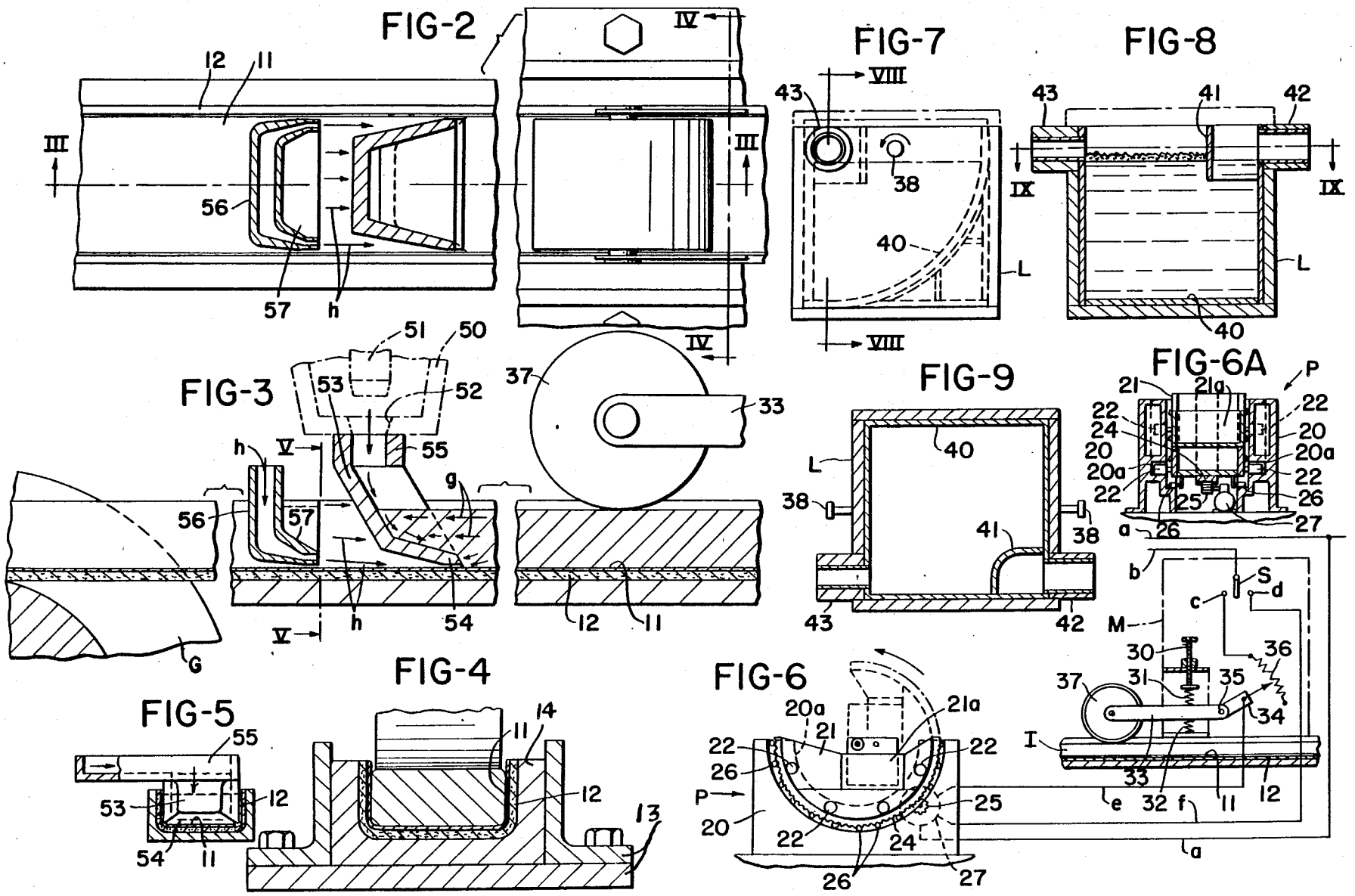
FIG. 2 is an enlarged top, broken, fragmental view, partially in section, of a portion of the casting line of FIG. 1, as taken along line II—II thereof.
FIG. 3 is a broken, fragmental side section in elevation on the scale of and taken along line III—III of FIG. 2; however, it shows by dot and dash lines a stopper type of feed.
FIG. 4 is a cross-sectional view in elevation on the same scale as and taken along the line IV—IV of FIG. 2.
FIG. 5 is a cross section in elevation on the same scale of and taken along the line V—V of FIG. 3.
FIG. 6 is a somewhat diagrammatic view in elevation illustrating electrical apparatus for controlling the rate of rotation of a ladle supporting cradle.
FIG. 6A is a cross section in elevation taken at right angles through the cradle, cradle box and pouring ladle assembly shown in FIGS. 1 and 6 and on the same scale as such FIG. 6.
FIG. 7 is an end view in elevation of the ladle shown in FIG. 1 and on an enlarged scale with respect thereto.
FIG. 8 is a vertical side section in elevation on the same scale as and taken along the line VIII—VIII of FIG. 7.
FIG. 9 is a horizontal section on the same scale as and taken along the line IX—IX of FIG. 8.

In FIG. 3, metal being poured moves downwardly along the back of the spout 53, as indicated by the "down" arrows, and into the mold wall defined by the composite represented by the ablative 11 and the flexible belt 12. Arrows g represent back pressure exerted by molten metal within the mold walls. To offset this, and to also prevent a back movement or leakage of metal behind the spout 53, a gas nozzle 56 is positioned in a spaced relation behind it. As shown, nozzle 56 has a spaced relation along its side edges with respect to the ablative 11 and terminates in a bottom spout end portion 57 having a planar face in a spaced relation to the bottom of the ablative. Its spout end 57 is shown reduced to a substantially transversely extending open delivery mouth portion whose lips are spaced from the bottom portion of the ablative 11. The construction assures that the ablative 11 is not held back or stripped with respect to the belt 12 during their forward movement.

The gas which may be air or preferably an inert gas, such as argon or nitrogen, is supplied by a conventional motor-driven compressor through a pressure control and shut-off valve (not shown) and a flexible hose connected to the outer end of the nozzle 56. Arrows h in FIGS. 2 and 3 represent the flow of gas. The gas pressure relates to the depth of the metal being cast, and on this basis may be about $\frac{1}{4}$ PSI per inch of thickness or depth of the metal in the composite mold. For instance, a two inch bar being cast will require about $\frac{1}{2}$ PSI of gas application. Although a small compensation has been made for some gas expansion that occurs between the nozzle delivery end 57 and the clearance spacing behind the metal supplying nozzle 53, as noted above, the pressure required will be relatively low. The gas application serves an additional function of tending to provide an initial cooling action on the metal being supplied from the nozzle 55 and particularly, along the sides and bottom of the metal, as it is being delivered to and advanced on the ablative material 11. The ablative material, in turn, will char under the heat of the molten metal which thus provides the metal with a cooled skin. Due to the lack of oxygen on the basis of the closed side and bottom construction of the mold, the ablative 11 will not burn and will be retained as an intermediate protective layer between the metal being cast and the advancing belt 12.

With reference to the ladle L, shown particularly in FIGS. 7, 8 and 9, it will be noted that it has a refractory lining 40 that is smoothly sloped along one side thereof. The upper reaches of the ladle L have a pair of trunnion-like pouring spouts 42 and 43, one of which 43 has an open bore for discharging slag (see the layer in FIG. 8) that overlies the molten metal. The other spout 42 serves to pour the molten metal content as the ladle L is tilted on cradle frame 20. A refractory partition wall portion 41 has a spaced relation with respect to a pouring opening or open bore through the trunnion spout 42 to isolate the molten metal from the slag layer, and to insure the pouring of clean metal therethrough into, for example, the refractory tundish 50 or tray 55.

As shown particularly in FIGS. 1, 6 and 6A, cradle frame or stand 20 has a pair of opposite, semicircular side guide slots **20*a* for receiving guide and hold down rollers 22 that are carried to project from opposite ends of a rotatable cradle 21. As shown in FIGS. 1 and 6, the cradle 21 has a ladle-receiving box 21*a*. A semicircular cradle gear ring or ratchet 24 is carried by one side of the rotatable cradle 21 and is adapted to be actuated by and meshed with a motor-driven pinion 25 of an electric motor 27. Rollers 26 carried in the guide slots also may be employed to rotatably support the cradle 21**.

The speed of the motor 27 which controls the rate of feed of molten metal from the revolving cradle 21 (see the arrow of FIG. 6) is controlled by a monitoring mechanism or unit M which is mounted on side rails of the longitudinally extending, support assembly 13 (see FIGS. 1, 4 and 6). As shown, the assembly 13 carries a longitudinally extending trough shaped, open-top, metal mold support wall 14 for the ablative-belt complex during the casting portion of the operation.

The monitor unit M is shown provided with a ceramic or heat-resistant sensor roller 37 that is rotatably carried by a back end of a swing arm 33. The arm 33 is pivoted to the frame of the sensor M on a shaft 35, and a rheostat operating finger 34 is also pivoted on the shaft 35 and secured to an inner end of the arm 33. The finger 34 is adapted to move along a variable resistance 36 in accordance with variations in the thickness of a substantially solidified portion of the metal ingot or shaped metal length I, as indicated by rolling contact of the sensor roll 37 with respect to its uppermost, exposed and solidified surface. Opposed springs 31 and 32 normally hold the arm 33 in a suitable operating relation for the sensor roll 37. The spring 31 is adjustable by means of a threaded stem which is secured to one end thereof. A control switch S is also shown in FIG. 6 for reversing the direction of rotation of the motor 27 in order to either move the ladle forwardly at a relatively slow rate by making contact with the terminal c so as to control its speed through the rheostat 36, or to return cradle 21 and the ladle L counter to the direction of the arrow in FIG. 6 to its original upright position. The reverse movement is effected by moving the arm of the switch S into contact with a reversing terminal d to thus quickly return it without the slower measured movement which is accomplished during a pouring operation.

As shown in FIG. 6, swing arm 33 is held in a suitable tensioned operating position between an under-positioned spiral spring 32 and an opposed, upward-positioned spiral spring 31 whose tensioning is adjusted by a threadably mounted, adjusting, thumb screw or stem 30. In this figure, a and b represent incoming electric power line leads from a suitable source for energizing the motor 27 which may be direct current driven. It will be noted that when the arm 33 of the switch S is moved into engagement or electrical contact with switch terminal c that the motor 27 is controlled in its speed of forward rotation by monitor roller 37 that rides on the upper solidified surface of the slab or ingot I as it is advanced forwardly. As shown, the roller 37 controls the position of the operating finger 34 and its position with respect to electrical resistance 36 to thus automatically control the amount of current supplied to the motor 27 through line e. On the other hand, when the arm of the switch S is moved into engagement or electrical contact with the terminal d, a flow of electric current along supply line f is effected to accomplish full reverse return rotation of the motor 27 and thus, a quick return rotation of the cradle 21 and of the ladle L to its initial upright position of FIG. 1. Since the return of the cradle L is directly accomplished without the use of the resistance 36 of the rheostat, it may thus be at a faster rate than its forward feed rotation. After the upright ladle L has been moved into alignment with the pouring spout (see FIG. 1) of the furnace N, it is thus ready to receive a new charge of molten metal and to then again be moved into a pouring position in the box 21*a* of the cradle 21.

On return of the ladle L to its upright position shown in FIG. 1, the overhead crane O may be hooked onto the lift lugs or trunnions 38 to return it to the track and move it to an aligned position with the pouring spout of the furnace N. It will be apparent that two or more ladles may be used to enable a substantially continuous operation from the standpoint of the feed of molten metal to the horizontal casting line.

Although, the monitor unit M has been shown as a sensor for controlling and maintaining a desired set thickness of the metal casting produced, it will be apparent to those skilled in the art that it may include a counter which will, through the agency of the number of rotations of the roller 37, determine the length of the casting that is produced to thus terminate the pouring operation when a desired length has been reached. However, in a continuous operation such as herein contemplated, the length of slab or ingot I may be advanced to a runout J (see FIG. 1) where it can be sheared to a suitable length by a conventional shear H, and then delivered sidewise to a wheeled shop car K for transporting to a suitable storage area or to processing equipment. Basically, the sensor system enables the operator to select a desired thickness of the ingot or slab I that is to be produced, to maintain such a thickness throughout the operation, to stop the feeding of molten metal at any time during the operation, to eliminate the need for a conventional stopper-tundish type of feed operation (see 50, 51 of FIG. 3), and to quickly return an empty ladle L to an upright position for removal and recharging.

The provision of a gas compartment, chamber or zone between the molten metal delivery spout or nozzle 53 and the gas delivery nozzle 56 is important for a number of reasons. Its metal feed spout or nozzle 53 as well as its gas supply nozzle 56 have a sidewise and depthwise, slightly spaced, clearance defining relation with respect to the forwardly advancing, heat-abstracting ablative 11, as shown in FIGS. 2 and 3. Both the spouts 53 and 56 have substantially planar edge portions extending along opposite sides and along the bottom of the substantially rectangular, trough-shaped, belt-supported ablative layer 11. In the first place, it enables a full sealing-off of the spacing between the nozzle 53 and the opposite sides and bottom portions of the ablative 11 during its advance on the belt 12, and without slippage with respect thereto, by the application of air or gas under a relatively low pressure. In the second place, it forms a molten metal meniscus and avoids the forming of pressure bubbles in the metal such as attained by the application of a high pressure application of the gas. Finally, it provides an initial and equalized surface cooling action fully along the opposite sides and the bottom wall of the molten metal as it is progressively fed and advanced along the composite ablative-belt mold. The provision of a gas chamber between the two nozzles avoids an undesirable localized concentration of the gas as applied between the nozzle 53 and the ablative 11.

What is claimed is:

1. An improved integrated system for supplying and forming molten metal into a continuous length casting of a selected uniform thickness, a horizontally longitudinally disposed layout having in progression an ablative supplying station, a belt introducing and shaping and ablative material-receiving station for forming a trough-shaped composite mold that has an inner wall of the ablative material and an outer supporting wall provided by the belt, a molten metal supplying station, a lengthwise extending casting station, means for progressively advancing the composite mold longitudinally to the metal supplying station and then along the casting station to form a solidified metal length, and monitoring means engaging a solidified surface of the metal while it is being advanced along the casting station for enabling an accurate rate of feed of molten metal into the composite mold at the supplying station that is determined by a desired thickness of the metal casting.

2. An integrated system as defined in claim 1 wherein, an ablative pre-shaping station is provided, the ablative material is supplied thereto as a continuous length of material and is progressively formed thereby into an open-top trough shape, means is provided at said belt introducing and shaping station for progressively forming the belt into an open-top trough shape about the trough-shaped ablative material to provide the composite mold, and means at said molten metal supplying station for progressively introducing molten metal into the trough-shaped composite mold at a rate determined by said monitoring means to assure the desired thickness of the metal casting.

3. An integrated system as defined in claim 1 wherein rotating cradle means at said molten metal supplying station is adapted to progressively introduce molten metal into the trough-shaped composite mold at a rate determined by said monitoring means.

4. An integrated system as defined in claim 3 wherein said monitoring means has a pressure-sensitive roller positioned to engage the upper solidified surface of the metal during its advancing movement along the casting station.

5. An integrated system as defined in claim 4 wherein said monitoring means has a motor for progressively forwardly rotating said cradle means at a rate determined by said pressure-sensitive roller.

6. An integrated system as defined in claim 5 wherein, an electrical line is provided for energizing said motor, a variable resistance is connected in said line for varying the speed of said motor, and said roller has means sensitive to the thickness of the metal casting for automatically varying said resistance and thus the speed of said motor.

7. An improved integrated system for forming molten metal into a continuous length casting of a desired uniform thickness along a horizontally longitudinally disposed line which comprises, a supplying station for a continuous length of ablative material, a pre-shaping station for progressively advancing and pre-shaping the ablative material along the line into a trough-shaped cross-section of the casting to be formed, a supplying station for a continuous belt of heat-resistant flexible material positioned along the line ahead of said ablative supplying and shaping stations for progressively receiving the pre-shaped ablative material thereon and pre-shaping the belt to substantially conform to the trough shape of the ablative material to thus progressively forming a composite open top mold for metal to be cast, a molten metal delivery station and a longitudinally extending metal casting station in progression along the line, means for continuously feeding molten metal from said delivery station at a controlled rate into the open top mold and for advancing the metal in the mold along the casting station while progressively solidifying it, and pressure-sensitive means positioned along the line for progressively engaging advancing solidified surface portions of the metal near the end of the casting station for monitoring the rate of delivery of molten metal to the composite mold.

8. A system as defined in claim 7 wherein, a rotatable cradle is positioned adjacent said molten metal delivery station, a molten metal charge carrying ladle is adapted to be removably positioned in an upright position on said cradle, motor means is operatively connected to said cradle for turning said ladle from its initial upright position through a tilting cycle to progressively pour molten metal therefrom into said composite open top mold while the latter is being advanced along said feeding station, and said pressure sensitive monitoring means is adapted to control the rate of tilting of said ladle as effected by said motor means.

9. A system as defined in claim 8 wherein, said ladle has a semicircular inner wall, has a metal pouring spout extending from one side thereof and a slag runoff spout extending from an opposite side thereof, and baffle means is positioned in said ladle for defining a molten metal runoff chamber and for isolating molten metal from slag therein.

10. A system as defined in claim 8 wherein, said motor means is electrically controlled, said pressure-sensitive means has a roller for progressively engaging advancing solidified surface portions of the metal casting, has an electrical resistance for controlling electrical energization of said motor means, and has an arm controlled by said roller and adapted to vary said electrical resistance in accordance with the thickness of the metal casting as determined by said roller.

11. A system as defined in claim 10 wherein means is operatively connected to said motor means for reversing its direction of rotation after the molten metal has been fully poured from said ladle to return said ladle to its initial upright position for removal to receive a new molten metal charge.

12. An integrated system for forming molten metal into a continuous length casting of a selected uniform thickness along a horizontally longitudinally disposed line which comprises, a supply station for a length of ablative material, a continuous belt of heat-resistant flexible material for receiving the ablative material from said supply station and advancing it forwardly along a longitudinally extending line, rear and head drive pulleys supporting and forwardly advancing upper reaches of said belt along the longitudinally disposed line, a molten metal feeding station in an advanced position along the line with respect to said rear pulley, said rear pulley having means adapted to introduce a forward end of said ablative material upon said forwardly advancing belt and to shape said ablative material and said belt into an ablative-lined trough-shaped composite having an open top, the thus-lined composite being advanced by said drive pulleys to said molten metal feeding station at which molten metal is introduced upon the ablative material of the composite, an open-top longitudinally extending trough-shaped guide member positioned along the line to guide said composite and the molten metal introduced thereon forwardly along the line while the metal is being subjected to a cooling-casting action therealong, said molten metal feeding station having a molten metal feed nozzle projecting downwardly into said composite in a sidewise and basewise slight clearance-spaced relation with respect to the ablative material to prevent damage thereto during forward movement of said belt, a gas nozzle in a backwardly spaced relation with respect to said molten metal feed nozzle and in a sidewise and basewise slight clearance-spaced relation with respect to the ablative material of the composite, and means for supplying gas under relatively low pressure to and directed from said gas nozzle in such a manner as to seal-off the clearance spacing of said feed nozzle and prevent the forming of pressure bubbles in the metal and prevent any backflow of molten metal through the spacing between the ablative material and said molten metal feed nozzle.

13. A system as defined in claim 12 wherein, a monitor is positioned along said trough-shaped guide member at a position where forwardly moving molten metal has at least partially solidified in the form of a casting, molten metal supplying means is positioned at said feeding station, and said monitor has means engaging an upper solidified surface of the metal and operatively connected to said supplying means for controlling the operation of said molten metal supplying means.

* * * * *